US006295338B1

(12) United States Patent
Kuzniar et al.

(10) Patent No.: US 6,295,338 B1
(45) Date of Patent: Sep. 25, 2001

(54) OIL COOLED BEARING ASSEMBLY

(75) Inventors: Daniel E. Kuzniar, Lyons; Jason P. Harris, Aurora; Gerald J. Carlson, Lombard, all of IL (US)

(73) Assignee: Marconi Medical Systems, Inc., Highland Heights, OH (US)

( * ) Notice: Subject to any disclaimer, the term of this patent is extended or adjusted under 35 U.S.C. 154(b) by 0 days.

(21) Appl. No.: 09/428,795

(22) Filed: Oct. 28, 1999

(51) Int. Cl.[7] ..... H01J 35/10

(52) U.S. Cl. ..... 378/132; 378/125; 378/127; 384/615

(58) Field of Search ..... 378/132, 127, 378/125, 126; 384/564, 569, 615; 313/11, 46, 364, 477 R

(56) References Cited

U.S. PATENT DOCUMENTS

| | | | | |
|---|---|---|---|---|
| 3,699,373 | * | 10/1972 | Holland et al. | 378/132 |
| 4,071,768 | | 1/1978 | Goodenough . | |
| 4,187,442 | * | 2/1980 | Hueschen et al. | 378/128 |
| 4,188,559 | | 2/1980 | Carville et al. . | |
| 4,326,144 | * | 4/1982 | Appelt | 378/132 |
| 4,519,093 | * | 5/1985 | Kurihara et al. | 378/132 |
| 4,641,332 | | 2/1987 | Gerkema . | |
| 4,644,577 | | 2/1987 | Gerkema et al. . | |
| 4,688,239 | | 8/1987 | Schaffner et al. . | |
| 4,914,684 | * | 4/1990 | Upadhya | 378/133 |
| 5,150,398 | * | 9/1992 | Nishioka et al. | 378/132 |
| 5,241,577 | | 8/1993 | Burke et al. . | |
| 5,274,690 | | 12/1993 | Burke et al. . | |
| 5,303,280 | | 4/1994 | Crawford et al. . | |
| 5,384,820 | | 1/1995 | Burke . | |
| 5,416,820 | | 5/1995 | Weil et al. . | |
| 5,516,214 | * | 5/1996 | Kakumoto et al. | 384/492 |
| 6,091,799 | * | 7/2000 | Schmidt | 378/137 |
| 6,125,169 | * | 9/2000 | Wandke et al. | 378/128 |

FOREIGN PATENT DOCUMENTS

| | | |
|---|---|---|
| 2 683 943 | 11/1991 | (FR) . |
| 1 544 604 | 3/1977 | (GB) . |

* cited by examiner

*Primary Examiner*—Drew Dunn
(74) *Attorney, Agent, or Firm*—John J. Fry; Eugene E. Clair

(57) ABSTRACT

An x-ray tube (20) comprising a cathode (23) and an anode (24) in operative relationship with the cathode (23). The anode (24) is mounted on a stem (32). The x-ray tube includes at least one bearing (58) rotatably receiving the stem (32). The at least one bearing (58) has an outer bearing race (66) in an outer race member, an inner bearing race (62) and a plurality of bearing members (64) operatively disposed between the inner and outer bearing races. The x-ray tube (20) also includes an evacuated envelope (78) which encloses the tube components and receives the outer race member of the at least one bearing (58) in thermally conductive contact along an inner surface (79).

31 Claims, 4 Drawing Sheets

OIL COOLED BEARING ASSEMBLY

BACKGROUND OF THE INVENTION

The present invention relates to rotating anode x-ray tube technology and is particularly related to apparatus that improves cooling and reduces heating of x-ray tube bearings. The invention also improves the ability of the x-ray tube bearing assembly to handle mechanical loads associated with larger rotating anodes and Computed Tomography (CT) systems.

Typically, an x-ray tube housing assembly includes an x-ray tube having an envelope made of metal or glass which is supported within an x-ray tube housing. The x-ray tube housing provides electrical connections to the x-ray tube supported within. The housing is filled with a fluid that surrounds the envelope, such as oil, to aid in cooling the x-ray tube by absorbing heat radiated from internal components of the x-ray tube.

In FIG. 1, a prior art x-ray tube 120 is schematically shown illustrating a common bearing assembly construction that limits bearing cooling effectiveness and bearing size, thereby limiting the thermal and mechanical loading of the bearings. The x-ray tube 120 includes a cathode assembly 122, an anode assembly 124, and an envelope 126. A housing 128 encloses the x-ray tube 120 and is filled with a cooling oil, or other suitable medium, which surrounds the tube 120.

The cathode assembly 122 includes a cathode focusing cup and at least one cathode filament. A support bracket mounts the cathode cup within the envelope. Electrical conductors are attached to the focusing cup and cathode filament. The conductors provide an appropriate source of electrical energy to each of the cup and filament respectively.

The anode assembly 124 includes a circular anode disk 130 that is mounted on a stem 132 in a conventional manner. A typical annular target area is located about the peripheral edge of the anode disk. The stem 132 is attached to a bearing shaft 133 which defines inner bearing races 134,136. An outer bearing member 146 is frictionally received in a high purity copper bearing housing 148. Outer bearing races 142, 144 are formed in the outer bearing member 146. A plurality of ball or other bearing members 140 are received between the inner bearing races 134, 136 and the outer bearing races 142, 144. The bearing housing 148 is attached to a non-electrically conducting portion of the envelope 128 with a bolt 125.

An induction motor 150 rotates the anode assembly 124. The induction motor includes a stator having driving coils 152 which are positioned outside the vacuum envelope 126. A rotor assembly 154 inside the envelope encloses the bearing assembly and is operatively attached to the anode stem 132. The rotor assembly 154 includes a cylindrical sleeve 156 attached in a known manner to a generally cylindrical support member 155 connected to the stem 132. Typically the sleeve 156, is formed of a thermally and electrically conductive material such as copper. When the motor is energized, the rotor assembly 154 rotates within the envelope 126.

In order to produce x-rays, the cathode filament is heated with an electric current such that thermonic emission occurs thereby producing a cloud of electrons. A high electrical potential, on the order of 100–200 kV, is applied across the cathode assembly and anode assembly. This potential causes the emitted electrons to flow from the cathode through the evacuated region in the envelope to the target on the rotating anode. The cathode cup focuses the electrons into a beam that is directed onto the annular target track. The electron bean impinges the target with sufficient energy that x-rays are generated.

The electron beam produces substantial heat when striking the anode during x-ray generation. Rotating anode configurations have been adopted to distribute the thermal loading created during the production of x-rays. Each portion along the path of the annular target portion becomes heated to a very high temperature during the generation of x-rays and is cooled as it is rotated before returning to be struck again by the electron beam. In many high powered x-ray tube applications, such as Computed Tomography (CT), the generation of x-rays often causes the anode assembly to be heated to a temperature range of 1200–1400° C., for example.

During operation of the x-ray tube, the x-ray tube is cooled by use of oil or other cooling fluid that surrounds the evacuated envelope and flows within the housing. The oil serves to absorb heat radiated by the anode assembly through the envelope. However, a portion of the heat radiating from the anode 130 is also absorbed by the rotor and bearing assembly. In addition, some heat is conducted from the anode 130 along the stem 132 into the bearing assembly. Some of the heat in the bearing assembly is radiated through the envelope 126 and a portion of the heat is conducted to the end of the bearing housing 148 near the mounting bolt 125. These mechanisms for removing heat from the bearing assembly are inefficient and result in bearing assembly component temperatures higher than desired.

Present x-ray tubes, as shown in FIG. 1, have a number of components surrounding the bearings such as the bearing housing and the rotor for the induction motor. These components (i) limit the efficiency of heat removal from the bearings, and (ii) limit the size of the bearing assembly components for a given tube and thus their ability to handle larger mechanical loads. As a result of the limits on the cooling of the bearing assembly, bearing temperatures of approximately 400° C. are common in many high powered x-ray tube applications. Unfortunately, such high temperatures may deleteriously effect bearing performance. For instance, prolonged and/or excessive heating of the lubricant applied to each ball of a bearing can reduce the effectiveness of the lubricant. In addition, the lubricant can be boiled off causing contamination of the vacuum in the x-ray tube. Further, prolonged and/or excessive heating may also shorten the life of the bearings, and thus the life of the x-ray tube. For these reasons it is desirable to (i) reduce the amount of heat that reaches the bearings and (ii) effectively remove heat in the bearings, regardless of its source.

One known method to reduce the amount of heat passed from the anode assembly to the bearing assembly is to mechanically secure a heat shield between the anode and the bearing assembly. The heat shield serves to protect the bearing assembly by intercepting a portion of the heat radiated from the anode 130 in the direction of the bearing assembly. Unfortunately, heat shields are not able to completely protect the bearing assembly from heat transfer from the anode 130 and a portion of the radiated heat will be absorbed by the bearing assembly. Additionally, although the heat shield is useful in reducing heat transfer to the bearing assembly, the heat shield does not play a role in cooling or removing heat already absorbed in the bearing assembly. Furthermore, given that the bearing assembly is enclosed by the rotor, the bearing assembly is not able to efficiently radiate heat to the cooling fluid contained in the housing. Thus, once heat has been transferred to the bearing assembly it is not readily dissipated.

Another disadvantage caused by the limit on bearing temperature is that various processes during manufacture of the tube, such as exhausting and seasoning the tube, are deleteriously affected. Exhausting the tube is the process in which vacuum is drawn in the tube. The tube is operated with internal components at high temperatures while a vacuum pump is operatively attached to the tube. The rate at which gas is removed from the tube and the resulting final pressure of the tube are related to the temperature of the components, such as the anode, during exhaust. The higher the temperature of the component the more effectively the gas is removed from the tube and the lower the pressure of the tube after exhaust. The bearing temperature limit results in reducing the temperature at which the components, i.e. the anode, can reach during exhaust.

The current bearing designs also limit component temperature during seasoning. Seasoning is the process in which the tube is exposed to progressively higher voltages and power. This "burn in" procedure assists in making the tube more electrically stable at high voltages experienced during tube operation. During the seasoning process the anode target focal track is exposed to some of the highest temperatures that it will experience. During seasoning, the focal track of the anode outgasses and evolves gas molecules into the vacuum envelope, thereby raising the gas pressure. The evolved gasses are absorbed by a getter within the vacuum envelope. Again, the bearing temperature limit causes a reduction in the temperature of the internal components during seasoning of the x-ray tube.

In addition, with higher power and/or higher velocity rotating anode applications, it is desirable to maintain acceptable runout specifications while increasing any of (i) the size of the anode disks, (ii) the rate of acceleration of the rotating anode to operating velocity and (iii) the rotational speed of the x-ray tube around the patient in a CT gantry. These higher power and/or higher velocity applications will present increased thermal and mechanical loads on the bearings. Present designs of bearing assemblies have a number of components surrounding the bearings which limit bearing size. Some of the components include the bearing housing and induction motor rotor. As a result of the limited bearing size, the mechanical and thermal loads that current sized bearing assemblies can handle without compromising bearing life and runout specifications is limited.

Anode size is also limited by present anode and bearing assembly mounting structures. Many of these mounting structures support the x-ray tube in a cantilevered fashion in the x-ray tube housing. This mounting arrangement requires that the mounting structure have sufficient strength to resist deformation during operation. However, since the mounting structure is typically the only point at which heat is conducted through the bearing assembly into the cooling oil, it is desirable to make the mounting structure out of a material that is a good thermal conductor. Materials that are good thermal conductors typically are not as resistant to deformation under normal x-ray tube mechanical operating loads experienced in CT systems. These two requirements, high strength and good thermal conductivity, often dictate conflicting choices in a mounting structure materials. Designs are often a compromise that attempt to select a material that can perform both functions satisfactorily.

Therefore, it is desirable to provide an x-ray tube that provides for more effective cooling of the bearings. More effective cooling of the bearings permits higher x-ray tube component temperatures, e.g. anode temperatures during exhaust, seasoning, and tube operation. It is also desirable to provide larger bearings to handle greater mechanical and thermal loads for larger and/or high power x-ray tube applications while maintaining runout specifications.

SUMMARY OF THE INVENTION

The present invention is directed to an x-ray tube that satisfies the need to provide an x-ray tube which has more effective cooling of the bearings and permit use of larger bearings, thereby supporting greater mechanical and thermal loads associated with anodes in higher power x-ray tubes. An x-ray tube in accordance with one embodiment of the present invention includes a cathode, an anode, a stem attached to the anode and at least one bearing for rotatably supporting the anode. The bearing has an outer bearing race member. The x-ray tube includes an evacuated envelope that has an inner surface. The envelope receives the outer bearing race member along the inner surface.

In accordance with a more limited aspect of the present invention, the inner bearing race is formed in the stem.

In another limited aspect of the invention, a portion of the stem forms the rotor of a motor.

In accordance with another limited aspect of the present invention, the envelope is made of non-conducting material and or non-magnetic material.

In accordance with a more limited aspect of the invention, the envelope of the x-ray tube is made of a ceramic material, such as Alumina.

In accordance with another limited aspect of the present invention, the envelope includes at least one race mount.

In accordance with a more limited aspect of the present invention, the race mount is metal. And in a yet more limited aspect of the present invention, the race is made of Kovar, a nickel alloy.

In accordance with another limited aspect of the invention, the inner race of the bearing is comprised of a material more resistant to heat transfer, for example stainless steel, than that comprising the stem.

Yet another limited aspect of the present invention, the envelope has a first envelope portion that houses the disk portion of the anode and the cathode. A second envelope portion secures the bearing in thermally conductive contact.

Yet a more limited aspect of the present invention, the first portion of the envelope is made from a first material and the second portion of the envelope is made from a second material.

In accordance with another aspect of the present invention, an x-ray tube comprises an anode, a stem for mounting the anode, a cathode and a bearing assembly. An evacuated envelope encloses the components and the envelope receives at least a portion of the bearing assembly along an inner surface of the envelope. Also included is a heat shield in physical contact with the envelope.

In accordance with another limited aspect of the present invention, the heat shield is proximate the stem.

In accordance with another limited aspect of the present invention, the heat shield has the shape of a truncated cone and has a generally central bore. The stem extends through the bore. The clearance between the stem and the heat shield is sufficient to allow free rotation of the stem within the bore.

In addition, a portion of the heat shield between the bore and the truncated cone may be machined out and forma void.

In accordance with another aspect of the present invention, an x-ray tube comprises a cathode, an anode in operative relationship with the cathode, a stem for mounting the anode and a bearing assembly for rotatably receiving the stem. The x-ray tube includes a cylindrical wall as a portion of the evacuated envelope that encloses the components and an inner surface of the cylindrical wall receives at least a portion of the bearing assembly.

Another aspect of the present invention includes an improved x-ray tube with the bearing housing forming a portion of the evacuated envelope.

Yet another aspect of the present invention is an improved x-ray tube having a first heat shield. A second heat shield is included that is in thermally conductive contact with the envelope.

Another aspect of the invention includes a cathode, an anode, a stem made of a first material with a first heat transfer coefficient attached to the anode. Attached to the stem are bearing mounts made of a second material with a second heat transfer coefficient. A bearing is mounted on the bearing mount and the bearing rotatably supports the stem.

One advantage of the present invention is that the bearings are more effectively cooled, thereby allowing higher temperatures of the tube components during exhaust, seasoning and operation.

Another advantage of the present invention is that it permits larger bearings to be used in x-ray tubes thereby accommodating greater mechanical and thermal loads associated with larger anodes.

Another advantage of the present invention is the reduction of the number of components used to construct the rotor portion of the motor for rotating the anode.

Yet another advantage of the present invention is extended bearing life.

The present invention provides the foregoing and other features hereinafter described and particularly pointed out in the claims. The following description and accompanying drawings set forth certain illustrative embodiments of the invention. It is to be appreciated that different embodiments of the invention may take form in various components and arrangements of components. These described embodiments being indicative of but a few of the various ways in which the principles of the invention may be employed. The drawings are only for the purpose of illustrating a preferred embodiment and are not to be construed as limiting the invention.

BRIEF DESCRIPTION OF THE DRAWINGS

The foregoing and other features and advantages of the present invention will become apparent to those skilled in the art to which the present invention relates upon consideration of the following detailed description of a preferred embodiment of the invention with reference to the accompanying drawings, wherein.

DETAILED DESCRIPTION

In the present invention, a new and different design and arrangement of bearing assembly components inside an x-ray tube provides for more efficient cooling of bearings for a rotating anode. In accordance with the present invention, bearing components inside the x-ray tube are located in thermally conductive contact with the evacuated tube envelope to allow more effective transfer of heat from the bearings to the cooling medium surrounding the tube envelope. This permits higher operating temperatures for other components of the x-ray tube since heat is more effectively removed from the bearings, e.g. higher anode temperature during out-gassing, seasoning and operation. In addition, the new and different design of the present invention permits locating the outer races of the bearings further away from the axis of rotation of the anode stem. This allows the use of increased outer race diameters and larger bearing members to support greater mechanical loads associated with higher power and/or higher velocity x-ray tubes that are to be used in Computed Tomography and other x-ray systems.

Figure 1:
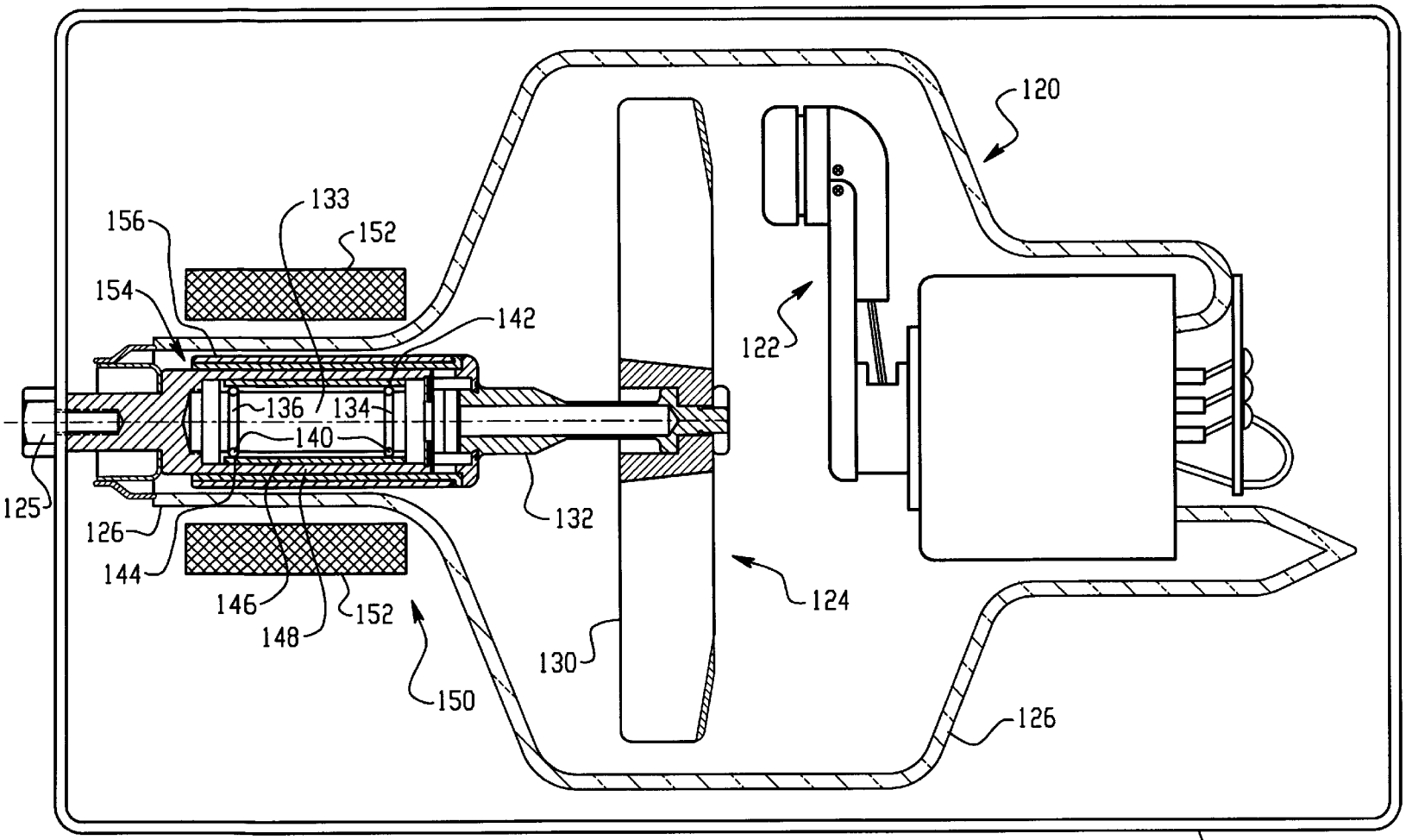
Fig. 1 PRIOR ART
FIG. 1 is a diagrammatic view in partial section of a prior art rotating anode x-ray tube.
Figure 2:
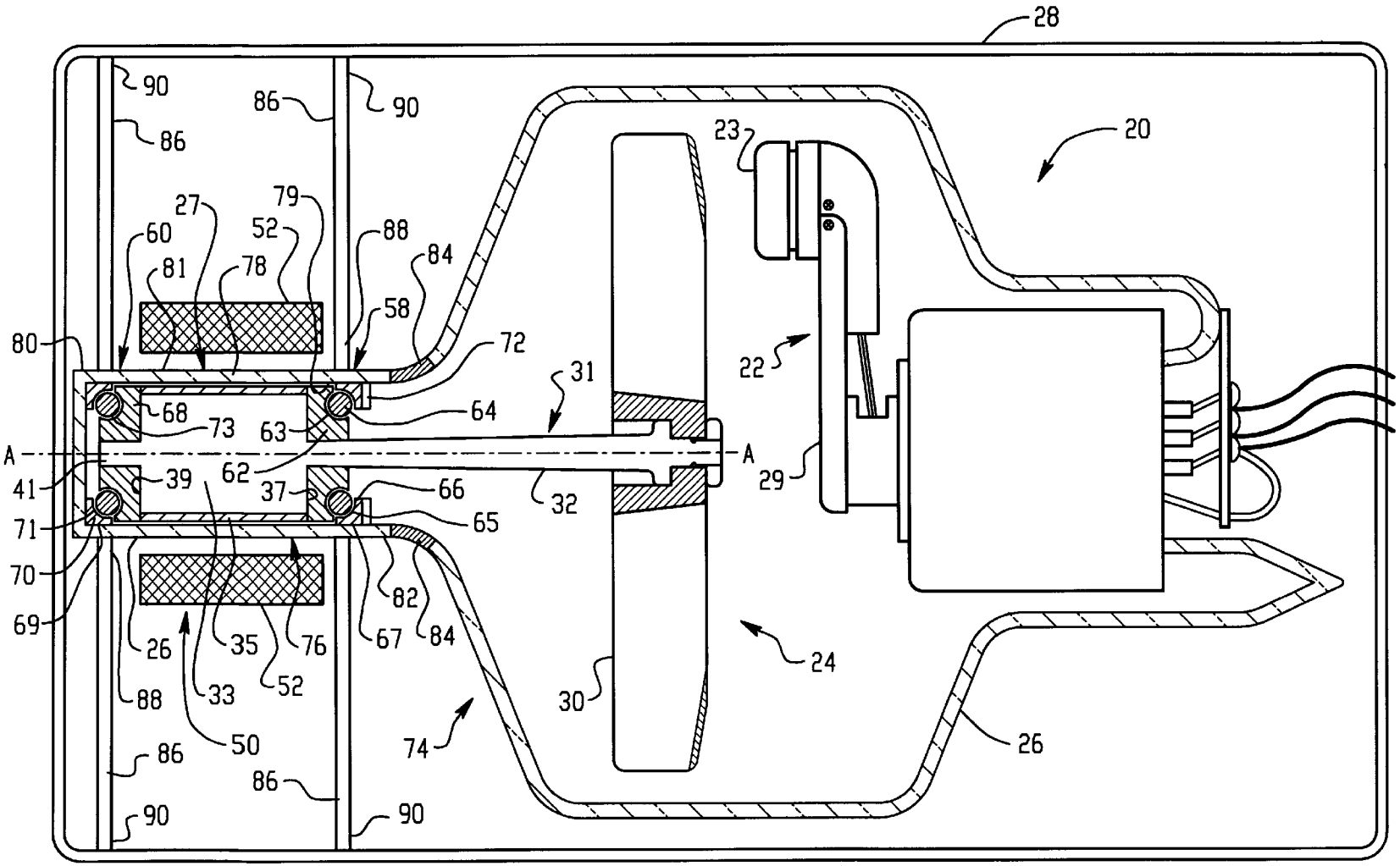
FIG. 2 is a diagrammatic view in partial section of a rotating anode x-ray tube in accordance with a preferred embodiment of the present invention.
Figure 3:
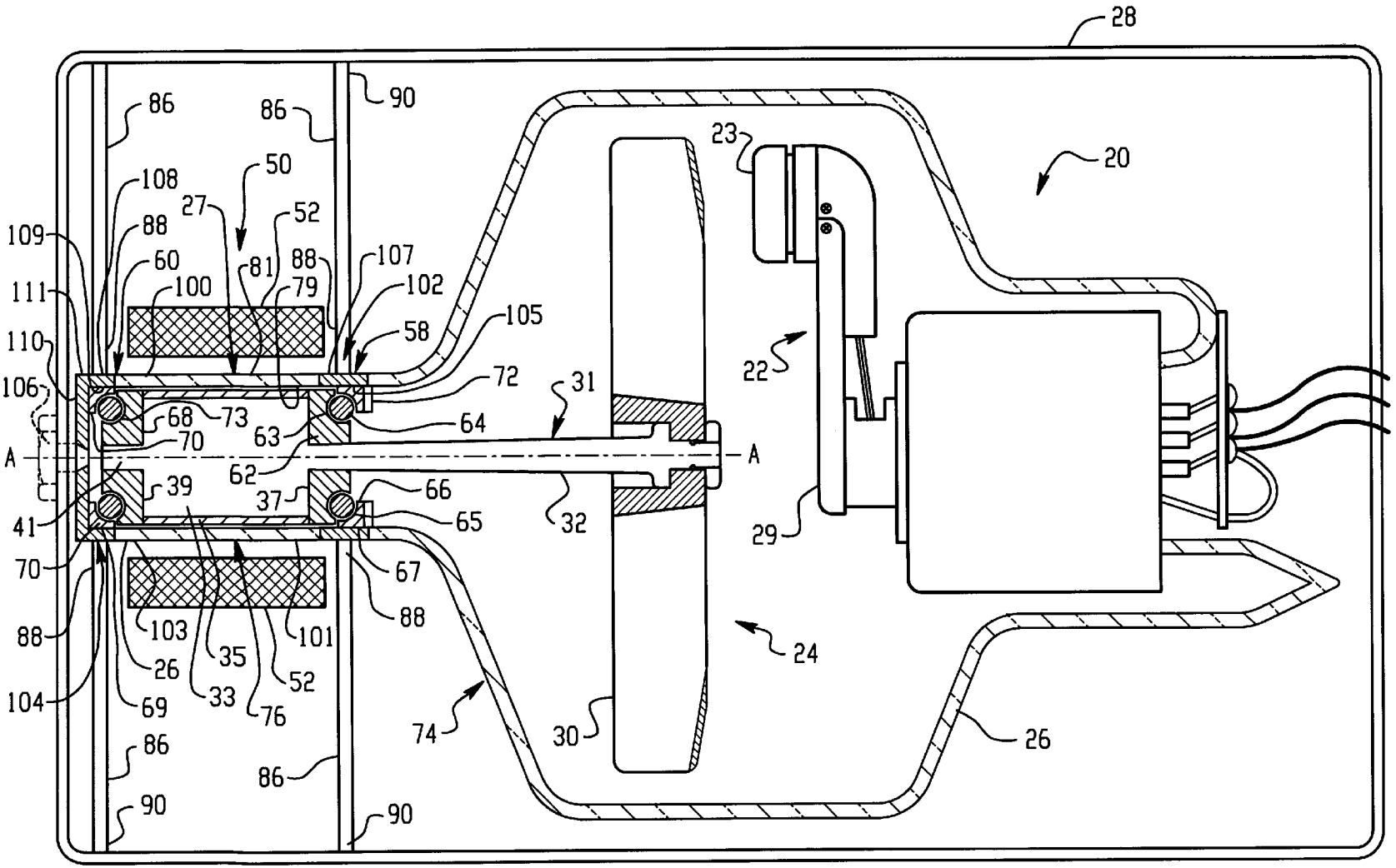
FIG. 3 is a diagrammatic view in partial section of a rotating anode x-ray tube in accordance with another embodiment of the present invention.

Referring now to FIG. 2, an x-ray tube 20 according to the preferred embodiment of the present invention includes a cathode assembly 22, an anode assembly 24, a bearing assembly 27, an evacuated envelope 26 and an induction motor 50. A housing 28 encloses the x-ray tube 20 and is filled with a cooling fluid such as oil, or other suitable medium, which surrounds the tube 20. The housing 28 shown in FIGS. 2–3 is a schematic representation of a structure that generally is constructed such that the necessary electrical connections to the x-ray tube are accessible via connector terminals. In addition, heat exchanger fluid connections (not shown) are provided to circulate and cool the fluid within the housing.

The cathode assembly 22 includes a cathode 23 that has at least one cathode filament and a focusing cup. The cathode 23 is supported in the envelope 26 on a cathode support bracket 29. Electrical conductors are attached to the focusing cup and cathode filament. The conductors extend from the cathode assembly 22, through the evacuated envelope 26 and x-ray tube housing 28, to appropriate sources of electrical energy to operate each of the focusing cup and cathode filament respectively.

The anode assembly 24 includes a typical circular or annular disk 30 comprised of suitable material for generating x-rays. The disk 30 is mounted in a conventional manner to a stem 32 at a shaft end 31 that supports the anode disk for rotation. The stem 32 has an axis of rotation that lies generally along the line A—A. The shaft end 31 extends along the axis A—A into a cylindrical rotor portion 33 of the stem 32. The rotor portion 33 of the stem 32 extends radially from the axis of rotation stem and has a diameter greater than the diameter of the shaft end 31. The narrower shaft end 31 extends into the rotor portion 33 at a first shoulder 37. The rotor portion 33 has a second shoulder 39 at its distal end. A distal end stem extension 41 protrudes from the second shoulder 39 along the axis of rotation. The stem extension 41 has a diameter less than the rotor portion 33.

The cylindrical rotor portion 33 preferably includes a cylinder 35, formed from an electrically conductive material such as copper or the like. The cylinder 35 is attached to and extends along the length and around the cylindrical perimeter of the rotor portion 33. The rotor portion 33 electromagnetically cooperates with stator drive coils 52 forming the induction motor 50 to rotate the anode assembly 24. The stator drive coils are typically located outside the envelope 26.

The evacuated envelope 26 includes first envelope portion 74 and a second envelope portion 76, also referred to as a neck. The first envelope portion 74 houses the disk 30 of the anode assembly 24 and the cathode assembly 22. Preferably, the first envelope portion 74 is comprised of glass, however, other suitable materials may be used such as metal or ceramic. Appropriate x-ray transparent window areas are provided, depending on the material selected for the first envelope portion 74.

The second envelope portion 76 houses the rotor portion 33 of the anode stem 32 and a pair of bearings 58, 60. The second envelope portion 76 has a closed end 80 forming a cup at one end of a generally cylindrical wall section 78. The other end 82 of the wall section 78, located nearer the anode, is an open end. The second envelope portion 76 has its major central axis extending generally along the line A—A. The cylindrical wall section 78 has an inner surface 79 and an outer surface 81 which is in contact with the cooling medium surrounding the envelope. This configuration permits the neck 76 of the envelope to serve as a portion of the bearing assembly 27, as further described in detail below. In the preferred embodiment, the second envelope portion 76 is comprised of an electrically non-conducting and non-magnetic material such as the ceramic Alumina. The material comprising the neck is selected to be thermally conductive and able to withstand the mechanical loads applied to it during tube operation. Alternatively other ceramics such as Beryllia and the like may be used. Beryllia is desirable for its high thermal conductivity but it has high cost and is difficult to work with.

The stem 32 is rotatably received in the bearing assembly 27 which includes, among other things, the second envelope portion 76 and the bearings 58, 60. The bearing 58 has an outer race member 66 defining an outer race 65. A surface 67 extends around the outer perimeter of the outer race member 66. The bearing 58 also includes an inner race member 62 defining an inner race 63. The inner race member 62 is attached to the rotor portion 33 around the shaft end 31 of the stem nearest to the anode and adjacent the first shoulder 37. A plurality of ball or other bearing members 64 are retained within the inner 63 and outer 65 races to rotatably support the stem 32.

The bearing 60 has an inner race member 68 defining an inner race 73 and an outer race member 70 defining an outer race 71. A surface 69 extends around the outer perimeter of the outer race member 70. The inner race member 68 is attached to the rotor portion 33 around the distal stem extension 41 adjacent the second shoulder 39. A plurality of bearing members 64, similar to those in bearing 58, are retained within the inner 73 and outer 71 races to support the stem extension 41. Alternatively, the outer race 71 can be machined directly into a properly formed annular material filled region in the closed end 80 of the second envelope portion 76.

The material in which the inner race members 62, 68 are formed is more resistant to heat transfer, thereby reducing the amount of heat transferred into the bearings from the stem. One example of a suitable material for the inner race member material is stainless steel. The stem may comprise a different material that is less resistant to heat transfer. Blocking heat transfer from the stem through the inner bearing race member assists in maintaining a lower bearing temperature in the x-ray tube when practicing the present invention. Alternatively, when the rotor portion is made of suitable material to withstand the requirements of a bearing race in an x-ray tube, the inner races 63, 73 may be machined and defined in opposite ends of the rotor portion 33 at suitable locations in the respective shoulder portions.

The thermally conductive path from the bearing 60 to the cooling medium is formed when the outer race member 70 of the bearing 60 is lightly press fit into the closed end 80 of the second envelope portion 76. Once in place, the outer perimeter surface 69 of the outer race member 70 is in direct contact with the inner surface 79 of the cylindrical wall portion 78. During further assembly, the bearing members 64 are placed in the outer race 71. The stem 32, with the attached inner race members 62, 68, is inserted into the neck. Next, additional bearing members 64 are placed in the inner race 63. The bearing race member 66 is likewise lightly press fit into the open end 82 of the wall section 78 thereby retaining the bearing members 64. The inner surface 79 is in direct contact with the perimeter surface 67 thereby completing another thermally conductive path. The outer race member 66 and other components of the bearing assembly are further retained in place with a locking spring 72.

The light press fit frictionally retains the race members 66, 70 in contact with the cylindrical wall portion 78 of the second envelope portion 76 without deformation of the envelope resulting in structural failure. In addition, the direct contact between the perimeter surfaces 67, 79 and the inner surface 79 of the wall section78 provides for conductive thermal contact between the outer bearing race members 66, 70 and the cooling medium. This provides a thermally conductive path that more effectively conducts heat out of the bearings into the cooling medium.

The first envelope portion 74 and the second envelope portion 76 are joined with a transition portion 84. In the preferred embodiment, with different materials for the two envelope portions, the transition portion 84 is an appropriately shaped and sized Kovar metal band to form an effective transition between the different materials. The transition portion 84 is brazed to the ceramic second envelope portion 76 in a known manner. The other end of the transition portion 84 is attached to the first envelope portion 74 in a conventional manner. The transition portion 84 is comprised of Kovar due to its desirable ability to connect materials having different thermal coefficients of expansion. The Kovar transition portion 84 permits the x-ray tube to operate without deleterious effects to the structural and vacuum integrity of the evacuated envelope 26 due to different thermal coefficients of expansion of the different materials in the first envelope portion 74 and second envelope portion 76.

When the second envelope portion 76 is formed entirely of electrically non-conducting material, it is necessary to provide an electric current path to remove anode current. A suitable contact for an electric current path from the anode extends through the cylindrical wall section 78 to a generator (not shown) that maintains the anode assembly 24 at operating electrical potential. For example, the current may be directed through the bearing 58 or 60 to a contact (not shown) that extends through the cylindrical wall section 78 and is electrically connected to the generator. Preferably, the contact to carry the current is placed at the rear bearing, i.e., bearing 60, since the rear bearing is generally at a lower temperature than the front bearing nearer the heat of the anode. However, the electrical contact may be placed at either bearing or any other suitable location adapted to electrically connect the rotor end of the anode assembly and the generator in order to provide a path for the anode current.

A plurality of schematically illustrated spaced apart tube supports 86 are provided to secure and retain the x-ray tube 20 within the housing 28. The supports have a tube end 88 for retaining the second envelope portion 76 of the x-ray tube 20 within the housing. Any of a number of known methods may be used to retain the tube such that detrimental deformation of the wall portion 78 is avoided. For example the, the x-ray tube may be retained with appropriately designed clamps, bosses or even lightly press fit into an advantageously shaped retaining member formed in or attached to the supports 86. The tube supports 86 have an opposite end 90 to be secured to the housing 28. The tube supports 86 are located adjacent to the bearings such that heat within the bearings 58, 60 is transferred through the wall portion 78 into the tube supports 86. In effect, the tube supports act as heat sinks to collect heat from the bearings, transfer it into the tube support and subsequently into the cooling fluid within the housing. Any number of suitable support configurations along the length of the first and second envelope portions may be used to supportably retain the entire x-ray tube 20 within the housing 28.

During operation of the x-ray tube 20, the anode assembly 24 is rotated within the bearings 58, 60 at high speed by the induction motor 50. Electric current is applied to the cathode filament and electrons are thermionically emitted from the cathode assembly 22. A large electric potential is applied across the anode and cathode. Electrons are accelerated across the vacuum space and impinge the target portion of the anode disk 30, thereby generating x-rays. Due to the x-ray generation process, the disk portion 30 is heated to high temperatures. Some of the heat in the anode is radiated through the first envelope portion 74 into the cooling oil and some of the heat is conducted from the disk 30 through the stem 32 to the rotor 33 and subsequently to the bearings 58, 60. The conductive path for heat transfer then proceeds from the bearings 58, 60 directly to the cylindrical wall section 78 and into the cooling oil surrounding the envelope 26. The direct thermal path between the bearings 58, 60 and the cylindrical wall section 78 provides for more effective cooling of the bearings 58, 60. The apparatus of the present invention more effectively conducts heat in the bearing members into the cooling medium and reduces heat transferred by conduction into the bearing members.

Referring now to FIG. 3, another configuration of the second envelope portion 76 of the present invention is shown. The second envelope portion 76 includes a tubular cylindrical wall section 100, a race member mount 102, and an end cap 104. The second envelope portion 76 houses the rotor portion 33 of the anode stem 32 and forms a portion of the bearing assembly 27. The cylindrical wall section 100 of the second envelope portion 76 has its major central axis extending generally along the line A—A. A circular first open end 101 of the cylindrical wall section 100 is located near the anode assembly 24. A circular second open end 103 is disposed at the distal end of the cylindrical wall section 100, located further away from the anode assembly. The wall section 100 is comprised of an electrically non-conducting and non-magnetic material such as a ceramic material like Alumina. Other suitable materials may be used for the wall section 100, such as those described above with respect to the wall section 78 shown in FIG. 2.

The advantages and distinctions of the present embodiment are related to the material comprising either or both of the race member mount 102 and the end cap 104 which are joined to the wall section 100 forming the second portion of the evacuated envelope. The race member mount 102 and end cap 104 are comprised of metal, such as Kovar, or the like. Kovar is preferred for its ability to serve as a transition material, as described above, to join the different materials of the first and second envelope portions. Some advantages of the present embodiment, are (i) easier machining to close tolerances for the bearings than an all ceramic second envelope portion, (ii) provision of an electrical path to the generator for the x-ray tube current via the metal race member mount or end cap, (iii) a more efficient thermally conductively path from the bearings to the cooling medium, depending on the metal selected. It is not necessary that both the end cap and race member mount be comprised of the same material. In addition, the ceramic cylindrical wall section 78 described above with the ceramic closed end 80 may be used with the metal race member mount 102.

In FIG. 3, the race member mount 102 is a generally cylindrical band located at the first open end 101 and has an inner circumferential surface 105 that receives the outer race member 66 of the bearing 58 along its perimeter surface 67. An outer circumferential surface 107 of the mount 102 is in contact with the cooling medium, or if desired attached to a tube support. Some of the purposes served by the race member mount 102, which affect its size and shape, are (i) providing an appropriate transition portion between the different materials of the first envelope portion and second envelope portion (ii) receiving the outer race member of the bearing 58 in a light press fit (iii) providing a thermally conductive path for heat into the cooling medium directly or into the tube support 86, (iv) providing a mounting location for the x-ray tube and (v) maintaining the vacuum seal integrity of the x-ray tube envelope.

The end cap 104 is cup shaped having an end cap cylindrical band 108 and a disk shaped end portion 110 located at one end of the cylindrical band 108. One end of the end cap cylindrical band has a circular opening in order to facilitate attachment of the end cap 104 to the cylindrical wall section 100 of the second envelope portion 76. The end cap cylindrical band 108 has a length and an inner circumferential surface 109. The inner surface 109 contacts the perimeter surface 69 of the outer race member 70 of the bearing 60 when received in the end cap 104. An outer circumferential surface 111 of the end cap band 108 is in contact with the cooling medium and/or attached to a tube support. In addition to, or in place of, the supports 86 the end cap 104 can be retained using a bolt 106 (shown in phantom). For such a mounting arrangement, the end portion 110 of the end cap 104 has an appropriate opening to threadably receive the retaining bolt 106 and still maintain vacuum integrity between the evacuated tube and oil filled enclosure.

A suitable path for electric current, that maintains the anode assembly 24 at operating electrical potential, is provided through the bearing 58 or 60 to the electrically conductive race mount member 102 or end cap 104. A contact (not shown) extends from the race mount 102 or end cap 104 and is electrically connected to the generator. Preferably, the contact to carry the current is placed in electrically conductive contact with the end cap 104 at the rear bearing, i.e., bearing 60, since the rear bearing is generally at a lower temperature than the front bearing nearer the heat of the anode. However, the electrical contact may be placed at either bearing or any other suitable location adapted to electrically connect the rotor end of the anode assembly and the generator in order to provide a path for the anode current.

During operation of the x-ray tube 20, the conductive path for heat transfer proceeds from the bearings 58, 60 directly to the race mount member 102 and end cap 104 respectively into the cooling oil surrounding the envelope 26 or the tube supports 86. The direct thermal path from the bearings 58, 60 through the race member mount 102 and end cap 104 provides for more effective cooling of the bearings 58, 60 when compared to prior arrangements.

Figure 4:
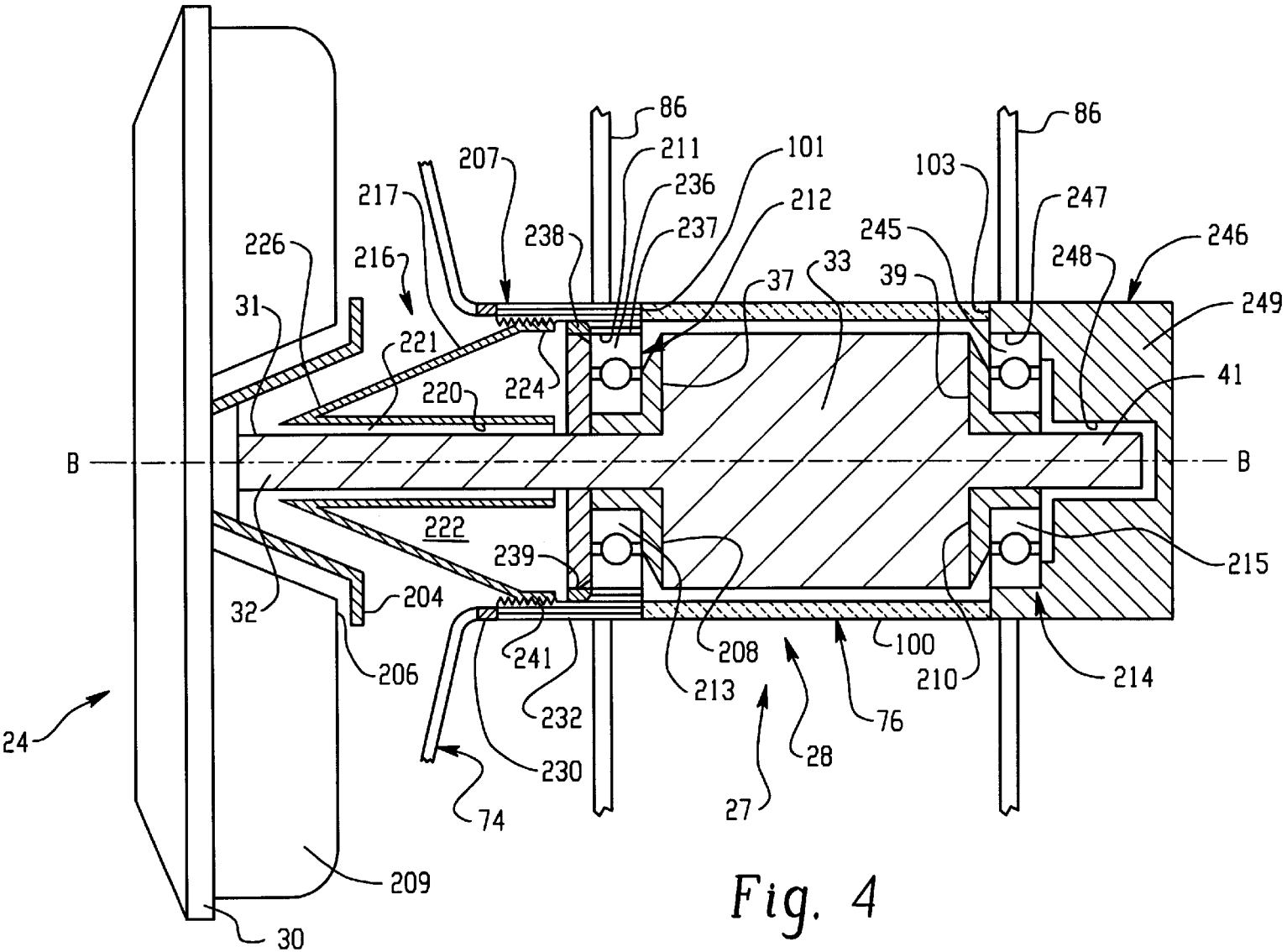
FIG. 4 is a partial diagrammatic view in partial section of a rotating anode x-ray tube in accordance with another aspect of the present invention.

Referring now to FIG. 4, another embodiment of the present invention employs a modified race mount member 232 and/or modified end cap 246 to be included in the second envelope portion described above. These modified structures are used in conjunction with an anode stem heat shield/absorber 216, further described in detail below. The heat shield/absorber 216 performs, either individually or in any combination, the functions of a heat shield, heat acceptor, heat sink and heat conductor. The anode stem heat shield/absorber 216 absorbs radiated heat directed from (i) a rear surface 206 of an anode back plate 209 and/or (ii) the shaft end 31 of anode stem 32. This absorbed heat is conducted through the heat shield 216 into the second envelope portion 76 and surrounding cooling medium. In one configuration, the heat shield acts as a heat sink in addition to heat shield and conductor. In addition, through a novel arrangement of the stem extension 41 and end cap 246, heat that is within the rotor portion 33 of the anode stem 32 is more effectively transferred from the stem into the cooling medium. This feature aids in removing heat that has progressed far enough into the anode stem that it can be transferred into the bearings. Heat removed from the stem via end cap 246 does not flow into the bearings. The structures included in this embodiment improve cooling of the bearing assembly and reduce the heat reaching the bearing assembly. Similar element numbers identify similar elements to those previously described in this detailed description with respect to other embodiments of the present invention.

The second envelope portion 76 includes a tubular cylindrical wall section 100, a race member mount 232, and an end cap 246. The second envelope portion 76 houses the rotor portion 33 of the anode stem 32 and forms a portion of the bearing assembly 27. The cylindrical wall section 100 has its major axis extending generally along the line B—B. A circular first open end 101 of the cylindrical wall section 100 is located near the anode assembly 24. A circular second open end 103 is disposed at the distal end of the cylindrical wall section 100, located further away from the anode assembly. The wall section 100 is comprised of an electrically non-conducting and non-magnetic material such as a ceramic material like Alumina. Other suitable materials may be used for the wall section 100, such as those described above for the other embodiments of the present invention.

The race member mount 232 is a generally cylindrical band comprised of copper, or like material that has similar suitable thermal conductivity and mechanical characteristics for retaining a bearing during x-ray tube operation. The race member mount 232 has an inner circumferential surface 205 that includes at least three portions along the length of the race mount 232. The first portion of the race mount 232 is a bearing race member receiving portion 211, located furthest from the anode assembly, which receives an outer race member 236 of a bearing 212 in a light press fit. The outer race member 236 has a perimeter surface 237 in contact with the receiving portion 211 of the race mount 232. The direct contact between the perimeter surface 237 of the race member 236 and the receiving portion 211 of the race mount 232 provides for conductive thermal contact with the outer bearing race member 236. This provides a thermally conductive path that more effectively conducts heat out of the bearings into the cooling medium. Alternatively, the outer race for the bearing 212 can be machined directly in the race mount 232 if it is formed from a material that has suitable mechanical characteristics for an x-ray tube bearing as well as the desired thermal properties to fulfill the purposes of the invention as described herein. Adjacent to the receiving portion 211 is an annular groove 239, provided for receiving a snap ring 238 that further retains the bearing 212 in the bearing assembly. The third section of the inner surface 205, located nearest the anode assembly, is a threaded portion 241.

The race mount 232 is configured to be suitably attached at its receiving portion end to the first open end 101 of the cylindrical wall 100. The threaded end of the race mount 232 is attached to a Kovar band 230 which, in turn, is joined in a conventional manner to the first envelope portion 74. When joined to the first and second envelope portions, the race mount 232 comprises a part of the vacuum envelope of the x-ray tube. As such, an outer circumferential surface 207 of the race mount 232 is in direct contact with the cooling medium, or if desired attached to a tube support 86 which can function as a heat sink.

A first heat shield 204 is attached to the anode assembly 24 to intercept heat radiated therefrom toward the shaft end 31 of the stem 32 and the bearing 212. The first heat shield 204 is of a conventional design configured to extend in an annular manner around a rear surface 206 of an anode back plate 209.

The anode stem heat shield/absorber 216 includes a truncated conical wall 217 and a generally cylindrical bore wall 220 with its longitudinal axis located along the major axis of the cone. The bore wall 220 defines a bore 221. The major axis of the conical wall 217 and the bore 221 lies generally along the axis B—B of the stem 32. A tapered portion 226 of the conical wall 217 is located nearest the anode assembly 32. The taper allows the heat shield 216 to extend along a greater length of the shaft end 31 and enclose it within the bore wall 220. Other tapered shapes which allow the heat shield to extend along a greater length of the stem end 31 toward the anode assembly 24 may also satisfactorily serve the objects of the invention. The bore wall 220 intersects the tapered end of the conical wall 217. At the other end of the conical wall section 217, a circular base portion 224 is located nearer to the bearing assembly 27. The base portion 224 is adapted around its exterior perimeter to be threadably received into the threaded portion 241 of the race mount member 232. The matching threads are configured to permit good physical and thermal contact to be made between the bearing mount 232, which forms part of the envelope 218, and the second heat shield 216. The shaft end 31 of the stem 32 is received within the shield bore 221 and is able to rotate freely therein.

The heat shield 216 is formed from a single piece and comprised of copper. Other good thermal conductors may be used for the heat shield 216. Alternatively, the conical wall 217 and the bore wall 220 may be individual parts that are appropriately joined. Preferably, the interior volume 222 of the cone between the conical wall 217 and bore wall 220 is machined away leaving a hollow interior. Thermal studies suggest that this configuration results in more effective processing of heat out of the heat shield 216 through the conical wall 217 into the bearing mount 232. Alternatively, the heat shield 216 may be solid, (in the area shown 222) except for the necessary central bore 221 to receive the shaft end 31 of the stem 32. In this alternate embodiment, the heat shield 216 also acts as a heat sink in addition to a thermal conduit to process heat out of the stem and bearings. It is to be appreciated that both configurations of this embodiment of the invention, solid and hollow between the walls 217, 220, provide for improved heat removal from the stem and bearings over prior designs of heat shields.

During the production of x-rays, heat is produced in the anode disk 30 and conducted from the anode assembly 24 through the shaft end 31 of the stem 32 into the bearings 212.

As the temperature of the stem 32 increases, heat is radiated from the shaft end 31 of the stem 32. The heat shield 216 absorbs the heat radiated from the shaft end 31 along the cylindrical bore wall 220. The heat absorbed in the bore wall 220 is conducted from the heat shield bore wall 220 to the tapered end 226 of the conical wall 217. From the tapered end of the conical wall 217 the heat is conducted to the threaded shield base 224, which is in good physical and thermal contact with the bearing mount 232 of the tube envelope 218. The heat is then transferred into the cooling medium. In addition, the second heat shield 216 also intercepts heat on the surface of its conical wall 217 that is radiated from the anode assembly 24 and the first heat shield 204. This heat is also conducted along the conical wall 217 into the bearing mount 232 and cooling medium. The heat shield 216 performs the functions of (i) intercepting and absorbing heat radiated from the anode assembly, (ii) absorbing heat radiated from the shaft end 31 of the stem 32 and (iii) conducting this absorbed heat into the bearing mount and cooling medium before it reaches the bearings, thereby reducing the amount of heat that is ultimately transferred into the bearings. When the heat shield 216 is of a solid configuration it performs the additional function of a heat sink, also reducing the heat transferred into the bearings.

Referring still to FIG. 4, another feature of the present invention, which reduces the amount of heat transferred into the bearings, includes generally annular internal race member mounts 208, 210 for bearings 212, 214. The inner race mount 208 is mounted around the shaft end 31 of the stem 32 adjacent to the first shoulder 37 of the rotor portion 33. An inner race member 213 for the bearing 212 is mounted to the inner race mount 208. The race mount 210 is mounted around the distal stem extension 41 adjacent the second shoulder 39 of the rotor portion 33. An inner race member 215 of the bearing 214 is mounted to the inner race mount 210.

The bearing mounts 208, 210 are made from a material that is more resistive to conductive heat transfer than the material of the stem 32. This combination of different materials having different thermal conductance reduces the amount of heat transferred by thermal conduction to the bearings 212, 214 from the stem 32. For example, stainless steel may comprise the bearing mounts 208, 210 and the stem may be comprised of a different more thermally conductive material. Other suitable materials may be used that have the desired thermal conductance coefficients as well as strength to satisfy the mechanical requirements for supporting the bearings during x-ray tube operation. The general annular shape of the bearing mounts 208, 210 is adapted to contact the surfaces of the stem and rotor portion to (i) securely retain the bearings on the stem with a friction fit or other suitable method and (ii) provide the heat blocking feature between the bearings 212, 214 and the stem 32. Heat that is not transferred into the bearings 212, 214 that remains in the rotor portion 33 of the stem 32 has a path via the stem extension 41 and the end cap 246 into the cooling medium. This additional feature of the present invention includes a new and different heat sink structure for absorbing heat radiated from the stem extension 41.

The heat sink structure is formed by a cup shaped cylindrical substantially solid copper end cap 246 that has two sections (i) an outer bearing race member mount section 247 at its open end and (ii) a heat sink section 249 at its closed end. The outer bearing race member mount section 247 is a relatively short cylindrical wall section defined by a circular disk shaped cavity forming the open end of the end cap 246. The cavity has sufficient depth into the solid copper heat sink to securely receive an outer race member 245 of the bearing 214 in a manner consistent with the features of the present invention and described above for the other bearing members. This provides a thermal path for conductive heat to flow from the bearing 214 through the vacuum envelope into the cooling medium surrounding the end cap 246. Alternatively, the outer race for the bearing 214 can be machined directly in the end cap 246 if it is formed from a material that has suitable mechanical characteristics for an x-ray tube bearing as well as the desired thermal properties to fulfill the purposes of the invention as described herein.

The heat sink section 249 of the end cap 246 is comprised of a solid copper, or the like, heat sink which includes a cylindrical bore 248 adapted to receive the stem extension 41 along the axis B—B and permit free rotation of the extension within the bore. The open end of the end cap 246 is appropriately bonded to the second open end 103 of the cylindrical wall portion 100 of the second envelope portion 76, thereby completing the vacuum envelope.

During x-ray tube operation, some of the heat conducted through the stem 32 is radiated from the stem rotor portion 33 to the cylindrical wall 100 of the tube envelope and subsequently into the surrounding cooling medium. With the thermally less conductive bearing mounts 208, 210 heat also is conducted through the rotor portion 33 into the stem extension 41 where it is radiated into the heat sink section 249. Heat is then conducted from the heat sink 249 into the cooling medium.

While a particular feature of the invention may have been described above with respect to only one of the illustrated embodiments, such features and materials may be combined with one or more other features of other embodiments, as may be appropriate or desired and advantageous for any given particular application.

From the above description of the invention, those skilled in the art will perceive improvements, changes and modification. Such improvements, changes and modification within the skill of the art are intended to be covered by the appended claims. For example, the perimeter surfaces of the outer bearing members of the first and second bearings 58, 60 may be pressed into a cylindrical bearing assembly wall section thereby forming a bearing assembly holding both bearings. This cylindrical bearing assembly wall section has a cylindrical perimeter surface that is received within the second envelope portion in contact with its inner surface 79. This cylindrical bearing assembly wall would be in thermally conductive contact with the envelope in a manner similar to the perimeter surface of the outer bearing race members described above referring to FIG. 2. In effect, the thermal path would still be a direct conductive path from the bearing to the cooling medium. However, this structure further includes the additional cylindrical bearing assembly wall section inserted between the outer bearing race member and the cylindrical wall section 79 of the second envelope portion.

Having described a preferred embodiment of the invention, the following is claimed:

1. An x-ray tube comprising:

a stem;

a cathode;

an anode attached to the stem;

at least one bearing for rotatably supporting the stem, the bearing having an outer bearing race member; and an evacuated envelope having an inner surface, the envelope receiving along the inner surface the outer bearing race member of the at least one bearing.

2. The x-ray tube of claim 1 wherein the at least one bearing includes an inner bearing race formed in the stem.

3. The x-ray tube of claim 1 wherein the stem comprises the rotor of a motor.

4. The x-ray tube of claim 1 wherein at least a portion of the envelope comprises electrically non-conducting material.

5. The x-ray tube of claim 1 wherein at least a portion of the envelope comprises non-magnetic material.

6. The x-ray tube of claim 5 wherein at least a portion of the envelope comprises a ceramic material.

7. The x-ray tube of claim 6 wherein the ceramic material is Alumina.

8. The x-ray tube of claim 1 wherein the envelope includes at least one race mount.

9. The x-ray tube of claim 8 wherein the at least one race mount is metal.

10. The x-ray tube of claim 9 wherein the at least one race mount is made of Kovar.

11. The x-ray tube of claim 1 wherein the at least one bearing includes an inner race member comprised of a material more resistant to heat transfer than the material comprising the stem.

12. The x-ray tube of claim 11 wherein the material comprising the inner race member is stainless steel.

13. The x-ray tube of claim 1 wherein the envelope has a first envelope portion that houses the anode and the cathode and a second envelope portion that secures the at least one bearing.

14. The x-ray tube of claim 13 wherein the first envelope portion is made from a first material and the second envelope portion includes at least a portion that is made from a second material.

15. The x-ray tube of claim 1 wherein the outer bearing race member is formed in a portion of the evacuated envelope.

16. A method for cooling bearings used to rotatably support an anode along an axis of rotation in an x-ray tube, the method comprising the steps of:

securing an outer race member of at least one bearing for rotating the anode along an inner surface of an evacuated envelope; and surrounding the x-ray tube in a cooling medium.

17. An x-ray tube comprising:

a stem;

an anode mounted to the stem;

a cathode in operative relationship with the anode;

a bearing assembly rotatably supporting the stem;

an evacuated envelope enclosing the anode, the stem, the cathode and bearing assembly, wherein the envelope receives at least a portion of the bearing assembly along an inner surface of the envelope; and a heat shield in physical contact with the envelope.

18. The x-ray tube of claim 17 wherein the heat shield is proximate the stem.

19. The x-ray tube of claim 18 wherein the heat shield includes a truncated conical wall member attached to a cylindrical wall defining a cylindrical bore for receiving the stem along its major axis, wherein the clearance between the heat shield and the stem permits the stem to rotate in the bore.

20. The x-ray tube of claim 18 wherein a void is defined in the heat shield between the truncated conical wall member and the cylindrical wall defining the cylindrical bore.

21. An x-ray tube comprising:

a cathode;

a stem having an anode end and a rotor end;

an anode mounted to the stem at the end of the anode end in operative relationship with the cathode;

a bearing assembly including at least two bearings rotatably receiving the stem at the rotor end, the bearings having outer bearing race members; and an evacuated envelope enclosing the cathode, the anode, the stem and the bearing assembly, wherein the evacuated envelope includes a cylindrical wall portion having an inner surface, the cylindrical wall portion of the evacuated envelope receiving the rotor end of the stem and the bearing assembly, the outer bearing race members in contact with the inner surface of the cylindrical wall portion receiving the rotor end of the stem.

22. The x-ray tube of claim 21 wherein at least one outer bearing race member is formed in the envelope.

23. An improved x-ray tube including an evacuated envelope, a cathode, an anode attached to a stem, the stem rotatably supported by a bearing assembly, wherein the improvement comprises:

at least one bearing of the bearing assembly engaging an inner surface of a wall portion of the evacuated envelope, wherein the envelope is in thermally conductive contact with the bearing.

24. An improved x-ray tube including an evacuated envelope surrounding a cathode, an anode attached to a stem which is rotatably supported by a bearing assembly, wherein the improvement comprises:

a heat shield in thermally conductive contact with the envelope.

25. The x-ray tube of claim 24 including a second heat shield for intercepting heat radiated from a surface of the anode.

26. The x-ray tube of claim 24 wherein the heat shield is a tapered member having a bore along its major axis and the stem extends through the bore, wherein the clearance between the heat shield and the stem permits the stem to rotate in the bore.

27. The x-ray tube of claim 26 wherein the heat shield is a truncated cone.

28. A method of reducing heating of bearings that rotatably support a stem attached to an anode in an x-ray tube having an evacuated envelope, the method comprising the steps of:

absorbing heat radiated from the stem into a heat absorbing member that proximately surrounds the stem and is in thermally conductive contact with the evacuated envelope; and conducting the absorbed heat through the absorbing member to the evacuated envelope.

29. An x-ray tube comprising:

a cathode;

a stem having an anode end and a rotor end, the stem comprised of a first material having a first thermal conductivity;

an anode attached to the anode end of the stem;

an envelope having a cylindrical wall portion enclosing the rotor end of the stem;

at least one bearing race mount attached to the rotor end of the stem, the bearing race mount made of a second material having a second thermal conductivity; and at least one bearing for rotatably supporting the stem in the cylindrical wall portion, the bearing having an inner bearing race member and an outer bearing race member, the inner bearing race member mounted on the bearing race mount and the outer bearing race member received along the cylindrical wall portion of the envelope.

30. The x-ray tube of claim 29 wherein the material for the bearing race mount is more resistive to heat transfer than the material for the stem.

31. An x-ray tube comprising:

a stem having an anode end and a rotor end, the rotor end having a stem extension;

an anode mounted to the anode end of the stem;

a cathode in operative relationship with the anode;

a bearing assembly rotatably supporting the stem; and an evacuated envelope enclosing the anode, the stem, the cathode and bearing assembly, wherein a portion of the envelope comprises a cylindrical wall portion receiving at least a portion of the bearing assembly along an inner surface of the cylindrical wall portion, the envelope includes an end cap at one end of the cylindrical wall portion, the end cap having a bore to receive the stem extension.

* * * * *